US011660508B2

(12) United States Patent
Chen

(10) Patent No.: US 11,660,508 B2
(45) Date of Patent: May 30, 2023

(54) LUMINOUS LEATHER FOR SPORTS BALL

(71) Applicant: ZHANGZHOU CITY GUANTENG SPORTS PRODUCTS CO., LTD., Zhangzhou (CN)

(72) Inventor: Lucheng Chen, Zhangzhou (CN)

(73) Assignee: ZHANGZHOU CITY GUANTENG SPORTS PRODUCTS CO., LTD., Zhangzhou (CN)

( * ) Notice: Subject to any disclaimer, the term of this patent is extended or adjusted under 35 U.S.C. 154(b) by 0 days.

(21) Appl. No.: 17/327,717

(22) Filed: May 23, 2021

(65) Prior Publication Data

US 2022/0347525 A1 Nov. 3, 2022

(30) Foreign Application Priority Data

Apr. 28, 2021 (CN) ..... 202120896953.6

(51) Int. Cl.
*A63B 41/08* (2006.01)

(52) U.S. Cl.
CPC ..... *A63B 41/08* (2013.01); *A63B 2243/0025* (2013.01); *A63B 2243/0037* (2013.01); *A63B 2243/0066* (2013.01); *A63B 2243/0095* (2013.01)

(58) Field of Classification Search
CPC ..... A63B 41/08; A63B 2243/0025; A63B 2243/0037; A63B 2243/0066; A63B 2243/0095; A63B 43/06
See application file for complete search history.

(56) References Cited

U.S. PATENT DOCUMENTS 3,445,551 A * 5/1969 Griffin ..... A63B 43/06 264/108
5,320,345 A * 6/1994 Lai ..... A63B 41/08 473/603
5,470,058 A * 11/1995 Sullivan ..... A63B 43/06 29/899.1
5,741,195 A * 4/1998 Sullivan ..... A63B 43/06 473/603
5,762,573 A * 6/1998 Kennedy, III ..... A63B 45/02 473/570

(Continued)

FOREIGN PATENT DOCUMENTS

GB 2209124 A * 5/1989 ..... A63B 43/06
KR 100391579 B1 * 7/2003
WO WO-02102465 A2 * 12/2002 ..... A63B 41/00

*Primary Examiner* — Steven B Wong
(74) *Attorney, Agent, or Firm* — Bayramoglu Law Offices LLC

(57) ABSTRACT

A luminous leather for a sports ball includes a base fabric, a polyurethane (PU) layer, a luminous layer and a film. The base fabric, the PU layer, the luminous layer and the film are sequentially bonded by glue from bottom to top. The luminous layer is a fluorescent coating. The luminous leather for the sports ball has an enhanced luminous effect while being wear-resistant. In the new luminous leather, the luminous layer is added, and the luminous layer is a fluorescent coating. In this way, sports balls made of the new luminous leather come in different surface colors to be more entertaining. Meanwhile, a film is immediately coated onto the luminous layer by a roller before the glue gets dry to enhance the luminous effect and the color brightness, while making the entire leather more wear-resistant.

2 Claims, 1 Drawing Sheet

(56) References Cited

U.S. PATENT DOCUMENTS

| | | | | |
|---|---|---|---|---|
| 10,258,836 | B2 * | 4/2019 | Molinari | A63B 41/08 |
| 2003/0232672 | A1 * | 12/2003 | Kim | A63B 41/00 473/570 |
| 2009/0325746 | A1 * | 12/2009 | Raynak | A63B 41/085 473/605 |
| 2019/0099644 | A1 * | 4/2019 | Hussain | A63B 41/10 |
| 2019/0105540 | A1 * | 4/2019 | Khawaja | B32B 7/12 |
| 2019/0160345 | A1 * | 5/2019 | Feng | A63B 41/08 |

* cited by examiner

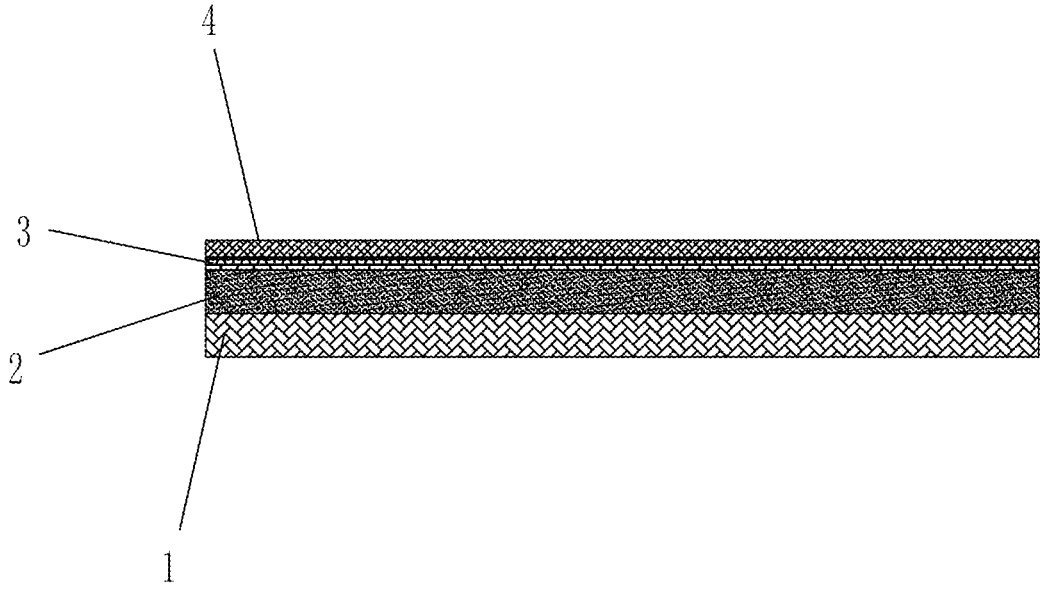
4
3
2
1

LUMINOUS LEATHER FOR SPORTS BALL

CROSS REFERENCE TO THE RELATED APPLICATIONS

This application is based upon and claims priority to Chinese Patent Application No. 202120896953.6, filed on Apr. 28, 2021, the entire contents of which are incorporated herein by reference.

TECHNICAL FIELD

The present invention belongs to the technical field of sports balls, and more particularly, relates to a luminous leather for a sports ball.

BACKGROUND

The surface layers of traditional sports balls, such as basketballs, footballs, rugby balls and volleyballs are typically made of polyvinyl chloride (PVC), polyurethane (PU), or leather, but these surface layers come in a single color. For young consumers, sports balls are generally used at night. In this case, if these sports balls come in a single color, then it is difficult to distinguish between them, which cannot attract the purchase intention of young consumers. Moreover, prior leather surface layers are easily worn out. Therefore, it is highly desirable to develop a luminous leather for a sports ball, which has an enhanced luminous effect while being wear-resistant.

SUMMARY

In order to overcome the shortcomings that the surface layers of sports balls in the prior art come in a single color and are easily worn out, the technical problem to be solved by the present invention is to provide a luminous leather for a sports ball, which has an enhanced luminous effect while being wear-resistant.

The present invention adopts the following technical solution.

A luminous leather for a sports ball includes a base fabric, a polyurethane (PU) layer, a luminous layer and a film. The base fabric, the PU layer, the luminous layer and the film are sequentially bonded by glue from bottom to top. The luminous layer is a fluorescent coating.

Further, the glue is basketball glue, or volleyball glue, or football glue.

Further, the sports ball is a basketball, a football, a rugby ball, a volleyball, or a playground ball.

Further, the base fabric, the PU layer, the luminous layer and the film constitute a thickness of 1 mm-2 mm.

Further, the base fabric is made of polyester yarn or cotton yarn.

Further, the film is made of a transparent and wear-resistant material.

Compared with the prior art, the present invention has the following advantages.

In the present invention, a luminous layer is added, and the luminous layer is a fluorescent coating. In this way, sports balls made of the aforementioned leather come in different surface colors to be more entertaining. Meanwhile, a film is immediately coated onto the luminous layer by a roller before the glue gets dry to enhance the luminous effect and the color brightness, while making the entire leather more wear-resistant.

BRIEF DESCRIPTION OF THE DRAWINGS

FIGURE is a schematic diagram of the structure of the present invention.

In the FIGURE: 1—base fabric, 2—PU layer, 3—luminous layer, 4—film.

DETAILED DESCRIPTION OF THE EMBODIMENTS

The present invention is further described below with reference to the drawings.

EMBODIMENT

As shown in FIGURE, a luminous leather for a sports ball includes the base fabric 1, the polyurethane (PU) layer 2, the luminous layer 3 and the film 4. The base fabric 1, the PU layer 2, the luminous layer 3 and the film 4 are sequentially bonded by glue from bottom to top. The luminous layer 3 is a fluorescent coating.

The glue is basketball glue, or volleyball glue, or football glue.

The sports ball is a basketball, a football, a rugby ball, a volleyball, or a playground ball.

The base fabric 1, the PU layer 2, the luminous layer 3 and the film 4 constitute a thickness of 1 mm-2 mm.

The base fabric 1 is made of polyester yarn or cotton yarn.

The film 4 is made of a transparent and wear-resistant material.

In order to overcome the shortcomings that the surface layers of sports balls in the prior art come in a single color and are easily worn out, the luminous layer 3 is added, and the luminous layer 3 is a fluorescent coating. In this way, sports balls made of the aforementioned leather come in different surface colors to be more entertaining. Meanwhile, a film is immediately coated onto the luminous layer 3 by a roller before the glue gets dry to enhance the luminous effect and the color brightness, while making the entire leather more wear-resistant.

Although the present invention has been described in detail with reference to exemplary embodiments, the present invention is not limited thereto. Additionally, it is obvious to those skilled in the art that various modifications and changes may be made without departing from the scope of the present invention.

What is claimed is:

1. A luminous leather for a sports ball, consisting of:

a base fabric made of a polyester yarn or a cotton yarn, a polyurethane (PU) layer, a fluorescent coating, and a film made of a transparent and wear-resistant material, wherein the base fabric, the PU layer, the fluorescent coating and the film are sequentially bonded by a glue from bottom to top, and the film is coated directly onto the fluorescent coating before the glue becomes dry, wherein the base fabric, the PU layer, the fluorescent coating and the film constitute a thickness of 1 mm-2 mm.

2. The luminous leather for the sports ball according to claim 1, wherein the sports ball is a basketball, a football, a rugby ball, a volleyball, or a playground ball.

* * * * *